US008974194B2

(12) United States Patent
Yin et al.

(10) Patent No.: US 8,974,194 B2
(45) Date of Patent: Mar. 10, 2015

(54) ADVECTION-TYPE FAN AND AN IMPELLER THEREOF

(75) Inventors: Tso-Kuo Yin, Kaohsiung (TW); Chih-Hao Chung, Kaohsiung (TW); Yuan-Jie Zheng, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 401 days.

(21) Appl. No.: 13/418,477

(22) Filed: Mar. 13, 2012

(65) Prior Publication Data

US 2013/0149128 A1 Jun. 13, 2013

(30) Foreign Application Priority Data

Dec. 9, 2011 (TW) ..... 100145602 A

(51) Int. Cl.
*F04D 25/06* (2006.01)
*F04D 25/08* (2006.01)

(52) U.S. Cl.
USPC ..... 417/420; 417/423.7; 417/423.8

(58) Field of Classification Search
CPC . F04D 13/024; F04D 25/0653; F04D 25/064; F04D 25/08
USPC ..... 417/420, 423.1, 423.7, 423.8
See application file for complete search history.

(56) References Cited

U.S. PATENT DOCUMENTS 4,164,690 A * 8/1979 Muller et al. ..... 318/400.41
4,885,488 A * 12/1989 Cox ..... 310/68 R
5,176,509 A * 1/1993 Schmider et al. ..... 417/423.7
5,944,497 A * 8/1999 Kershaw et al. ..... 417/423.8
6,232,690 B1 * 5/2001 Schmider ..... 310/156.37
7,045,919 B1 * 5/2006 Lin ..... 310/67 R
7,061,155 B1 * 6/2006 Lee ..... 310/261.1
7,474,032 B2 * 1/2009 Horng et al. ..... 310/268
7,619,337 B2 * 11/2009 Kasai et al. ..... 310/89
7,695,256 B2 * 4/2010 Horng et al. ..... 417/420
8,324,766 B2 * 12/2012 Chen et al. ..... 310/62
2009/0148086 A1 * 6/2009 Kuo et al. ..... 384/440

FOREIGN PATENT DOCUMENTS

TW 553323 9/2003
TW M350746 2/2009

* cited by examiner

*Primary Examiner* — Peter J Bertheaud

(74) *Attorney, Agent, or Firm* — Alan D. Kamrath; Kamrath IP Lawfirm, P.A.

(57) ABSTRACT

An impeller of an advection-type fan includes a metal base plate, a shaft and a plurality of plastic blades. The metal base plate includes a shaft-coupling portion and a peripheral portion, with a first plane facing in a first direction and a second plane facing in a second direction opposite to the first direction arranged between the shaft-coupling portion and the peripheral portion. The metal base plate is in a plane form between the shaft-coupling portion and the peripheral portion. The shaft has a fixing end and a free end. The fixing end is coupled with the shaft-coupling portion, and the free end extends in the first direction. Each plastic blade has a coupling portion and an air-driving portion. The coupling portion is coupled with the peripheral portion, and the air-driving portion extends in the second direction.

25 Claims, 8 Drawing Sheets

ADVECTION-TYPE FAN AND AN IMPELLER THEREOF

BACKGROUND OF THE INVENTION

1. Field of the Invention

The present invention generally relates to an advection-type fan and an impeller thereof and, more particularly, to an advection-type fan that can guide air in and out of the fan in a horizontal direction and an impeller thereof.

2. Description of the Related Art

Conventional cooling fans are mainly categorized into two types: an axial-flow type and a blower type. The axial-flow type cooling fan has an axial air inlet and an axial air outlet opposite to the axial air inlet. Air can be drawn via the axial air inlet and then expelled via the axial air outlet. The blower type cooling fan has an axial air inlet in the axial direction and a radial air outlet in the radial direction thereof. Thus, air can be drawn via the axial air inlet and then expelled via the radial air outlet for a cooling operation.

However, the axial-flow type cooling fan must be mounted on a top of an electronic device to be cooled, such as a Central Processing Unit (CPU) of a computer. This is because the axial-flow type cooling fan can only expel air in the axial direction rather than the radial direction. Therefore, the axial height of the electronic device cannot be reduced. In addition, since the blower type cooling fan draws air via the axial air inlet (in the axial direction) and expels air via the radial air outlet (in the radial direction), the blower type cooling fan cannot be applied to electronic devices that draw air from a lateral side (from the radial direction), such as a handset or a Personal Digital Assistant (PDA).

In light of the problems, conventional advection-type fans capable of drawing and expelling air in the radial direction are currently available in the market. Such fans can be applied to electronic devices that draw air from a lateral side. However, since the modern electronic devices usually have a miniature design, the axial height of an impeller of the advection-type fan must be efficiently reduced without affecting the air-driving ability in order for the advection-type fan to be applied to the miniaturized electronic devices. The impeller of the advection-type fan is integrally formed of plastic material or integrally formed by a punching process of metal material. When the impeller is integrally formed into a predetermined shape by plastic material, the impeller may have a smaller structural strength if the impeller has a smaller thickness. Although the thin impeller may have a larger structural strength when integrally formed by a punching process of metal material, the costs are increased if a greater amount of metal material is used, and the weight is also increased when the motor drives the impeller to rotate, affecting the overall operation efficiency of the motor.

Referring to FIG. 1, Taiwan Patent No. M350746 discloses a thin rotor 8 having a thin impeller that is currently a common impeller design in the market. The rotor 8 has a metal housing 81, a shaft 82 coupled to a center of the metal housing 81, and a metal blade frame 83 extending outwards from a periphery of the metal housing 81 in a radial direction. The metal blade frame 83 is coupled with a plastic blade portion 84. In this arrangement, although the rotor 8 is thin, the rotor 8 may still have a larger structural strength, since the primary structures of the rotor 8 are the metal housing 81 and the metal blade frame 83. Further, the rotor 8 also has a lower cost, since the structure used to drive air is made of plastic (the plastic blade portion 84), allowing the rotor 8 to be manufactured in a thin form with an improved structural strength. However, the rotor 8 still has some problems stated below.

First, the rotor 8 is only suitable for use in a blower, because the air-driving faces of the plastic blade portion 84 face two opposite axial directions of the shaft 82. Although the rotor 8 may have a thin form with improved structural strength, the rotor 8 is not suitable for use in an advection-type fan.

Second, the rotor 8 has a hub 85 that blocks the airflows driven by the plastic blade portion 84. The part of the rotor 8 between the center of the metal housing 81 (where the shaft 82 is coupled) and the outer periphery of the metal blade frame 83 (where the plastic blade portion 84 is coupled) is not in a planar form. Namely, the structure of the rotor 8 where the metal housing 81 connects to the metal blade frame 83 forms the hub 85 having a protrusion form. Moreover, the top edge 841 of the plastic blade portion 84 is also not higher than the top face of the hub 85 in an axial direction. As a result, the hub 85 will block the airflows driven by the plastic blade portion 84 in a great extent when the rotor 8 is installed in an advection-type fan for driving the air in and out of the fan in the radial direction, affecting the performance of the rotor 8.

Referring to FIG. 2, another conventional advection-type fan 9 is disclosed by Taiwan Patent No. 553323 entitled "Fan Structure Having Horizontal Convection". The conventional advection-type fan 9 includes a housing 91 and an impeller 92. The housing 91 has at least one air inlet 911 and at least one air outlet 912, with a horizontal air channel 913 formed between the at least one air inlet 911 and the at least one air outlet 912. The impeller 92 is disposed in the horizontal air channel 913 and includes a hub 921 having a plurality of blades 922 on an outer circumferential face thereof. In such an arrangement, the impeller 92 may rotate to create an air pressure difference between the at least one air inlet 911 and the at least one air outlet 912. Thus, airflows can be created between the at least one air inlet 911 and the at least one air outlet 912 for a cooling purpose.

In the above structure, since the blades 922 are formed on the outer circumferential face of the hub 921 and the top edge of each blade 922 is aligned with a top face of the hub 921, the hub 921 will block the airflows and therefore limits the airflow capacity of the advection-type fan. Thus, the cooling efficiency of the advection-type fan is significantly reduced, and turbulences and noises easily result.

In summary, the thin impeller used in a blower and the regular impeller used in a modern advection-type fan both have a common problem of larger area occupancy resulting from the hub 921, 85 taking up too much area of the air channel of the fan, reducing the airflow capacity of the fan and resulting in an unsatisfied cooling efficiency. In light of this, there exists a need to improve the advection-type fan and the impeller thereof.

SUMMARY OF THE INVENTION

It is therefore the primary objective of this invention to provide an advection-type fan that can prevent blocking of airflows when an impeller of the fan guides air in and out of the fan in a radial direction.

It is another objective of the invention to provide an impeller which consists of a metal base plate and a plurality of plastic blades for use in an advection-type fan, such that the impeller is allowed to have a smaller thickness and an improved structural strength and is therefore well-fitted to the thin advection-type fan.

The invention discloses an impeller of an advection-type fan including a metal base plate, a shaft and a plurality of plastic blades. The metal base plate includes a shaft-coupling portion and a peripheral portion distant from the shaft-coupling portion. A first plane facing in a first direction and a second plane facing in a second direction opposite to the first direction are arranged between the shaft-coupling portion and the peripheral portion. The metal base plate is in a plane form between the shaft-coupling portion and the peripheral portion. The first plane is provided with a permanent magnet. The shaft has a fixing end and a free end distant from the fixing end. The fixing end is coupled with the shaft-coupling portion of the metal base plate, and the free end extends axially in the first direction. Each plastic blade has a coupling portion and an air-driving portion. The coupling portion is coupled with the peripheral portion of the metal base plate, and the air-driving portion axially extends in the second direction.

Furthermore, the invention discloses an advection-type fan comprising a fan frame, a driving module and an impeller. The fan frame comprises a first cover portion and a second cover portion. A lateral wall portion is arranged between the first and second cover portions and comprises an air inlet and an air outlet. The driving module is disposed in the fan frame. The impeller comprises a metal base plate, a shaft and a plurality of plastic blades. The metal base plate comprises a shaft-coupling portion and a peripheral portion. A first plane facing in a first direction and a second plane facing in a second direction opposite to the first plane are arranged between the shaft-coupling portion and the peripheral portion. The first plane is provided with a permanent magnet. The shaft is coupled with the shaft-coupling portion of the metal base plate and rotatably coupled with the driving module. Each plastic blade has a coupling portion and an air-driving portion. The coupling portion is coupled with the peripheral portion of the metal base plate, and the air-driving portion axially extends in the second direction.

In a preferred form shown, the driving module comprises a shaft seat and a base plate. The shaft seat is arranged on the first cover portion of the fan frame. The shaft of the impeller is coupled with the shaft seat of the driving module. The base plate is fitted around the shaft seat and includes one face having a coil unit. An axial air gap is formed between the permanent magnet of the driving module and the coil unit.

In a preferred form shown, each plastic blade has a top edge facing in the second direction and spaced from the second plane of the metal base plate by an axial height.

In a preferred form shown, the top edges of the plastic blades jointly define a horizontal reference plane in which a horizontal air-guiding room is constructed between the horizontal reference plane and the second plane of the metal base plate.

In a preferred form shown, the air-driving portions of the plastic blades are annularly arranged to define the horizontal air-guiding room.

In a preferred form shown, the air-driving portions of the plastic blades are located above the second plane of the metal base plate in an axial direction.

In a preferred form shown, the fixing end of the shaft is aligned with or located below the second plane of the metal base plate.

In a preferred form shown, the plastic blades are integrally formed with the peripheral portion of the metal base plate by way of injection molding.

In a preferred form shown, the metal base plate further comprises a plurality of through-holes extending through the first and second planes, with a rib formed between two adjacent through-holes.

In a preferred form shown, the shaft is coupled with the shaft-coupling portion of the metal base plate via a shaft sleeve.

In a preferred form shown, the shaft sleeve is a plastic shaft sleeve that integrally couples the shaft with the shaft-coupling portion of the metal base plate. The shaft-coupling portion of the metal base plate forms a plurality of notches or has a saw-toothed inner periphery or a noncircular hole.

In a preferred form shown, the first and second planes of the metal base plate are uncovered or covered with a plastic or rustproof film.

In a preferred form shown, the air outlet has a smaller opening than the air inlet.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
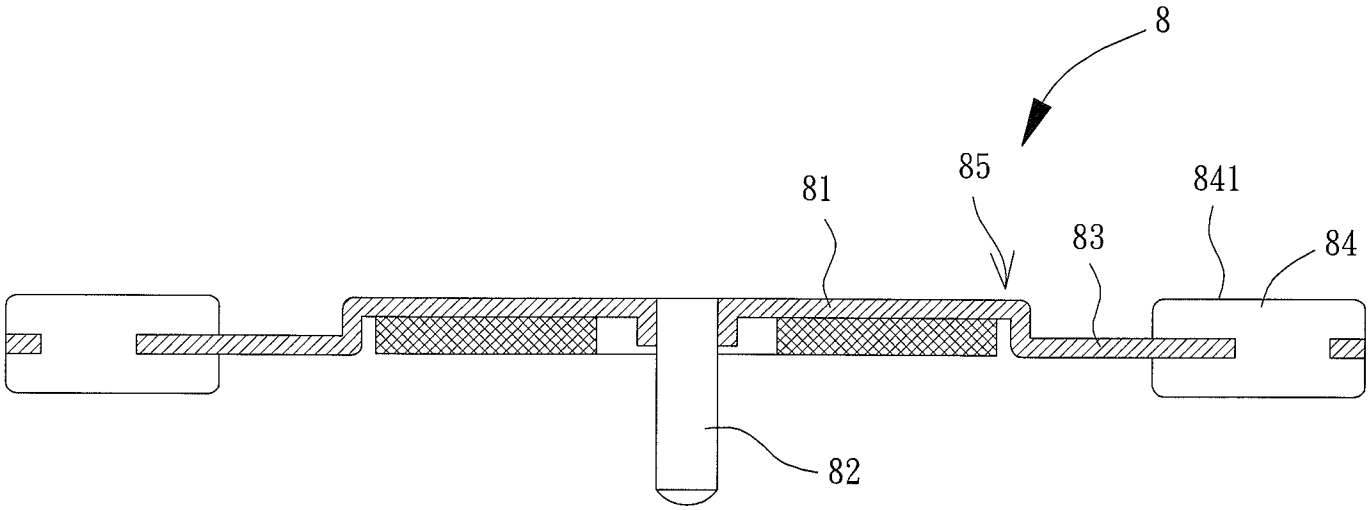
FIG. 1 PRIOR ART
FIG. 1 is a cross-sectional view of a rotor of a conventional thin fan.
Figure 2:
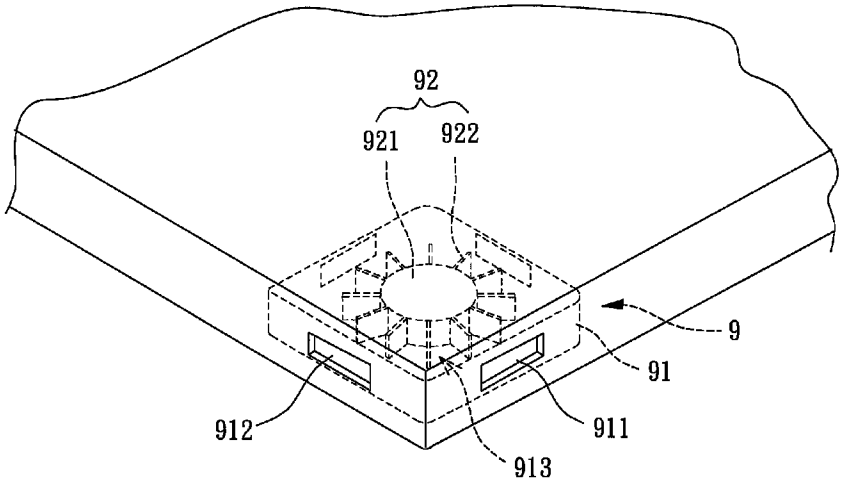
FIG. 2 PRIOR ART
FIG. 2 shows a conventional advection-type fan installed in an electronic device.

In the various figures of the drawings, the same numerals designate the same or similar parts. Furthermore, when the terms "first", "second", "third", "fourth", "inner", "outer", "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 3:
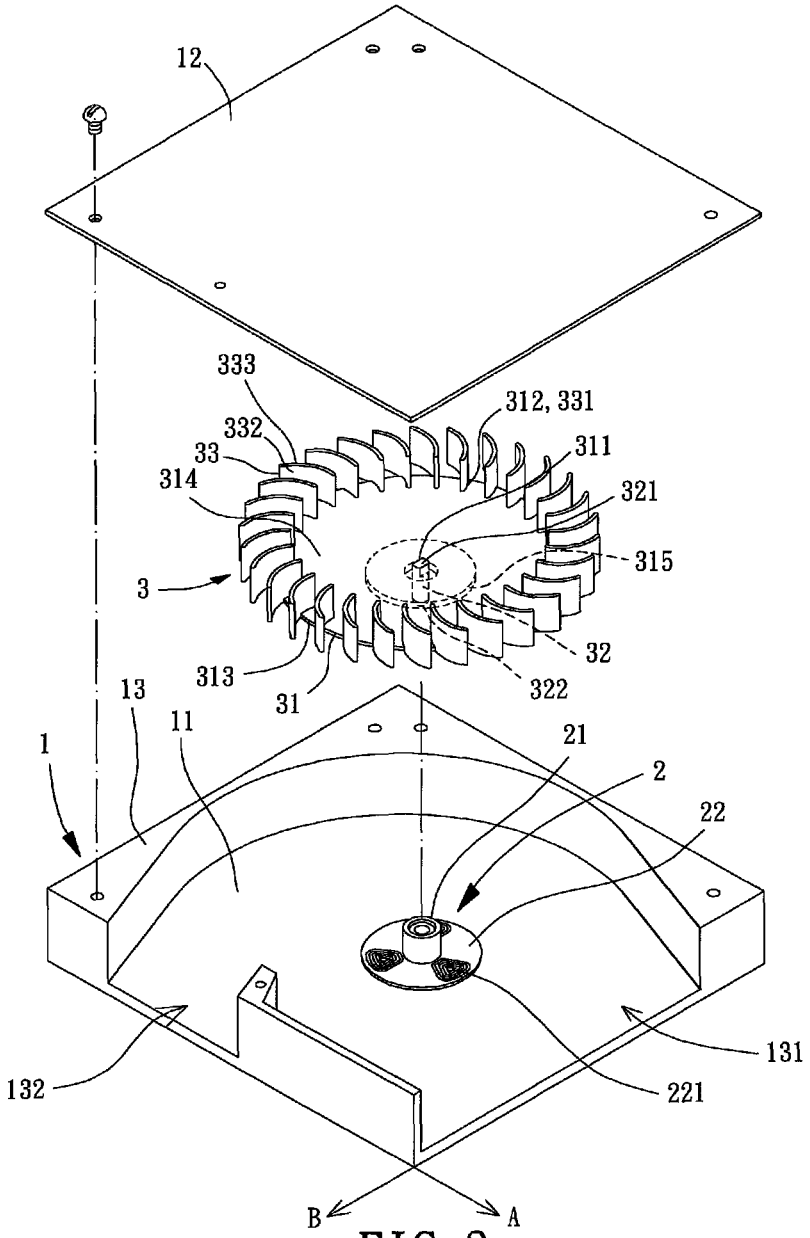
FIG. 3 is an exploded view of an advection-type fan according to a first embodiment of the invention.
Figure 4:
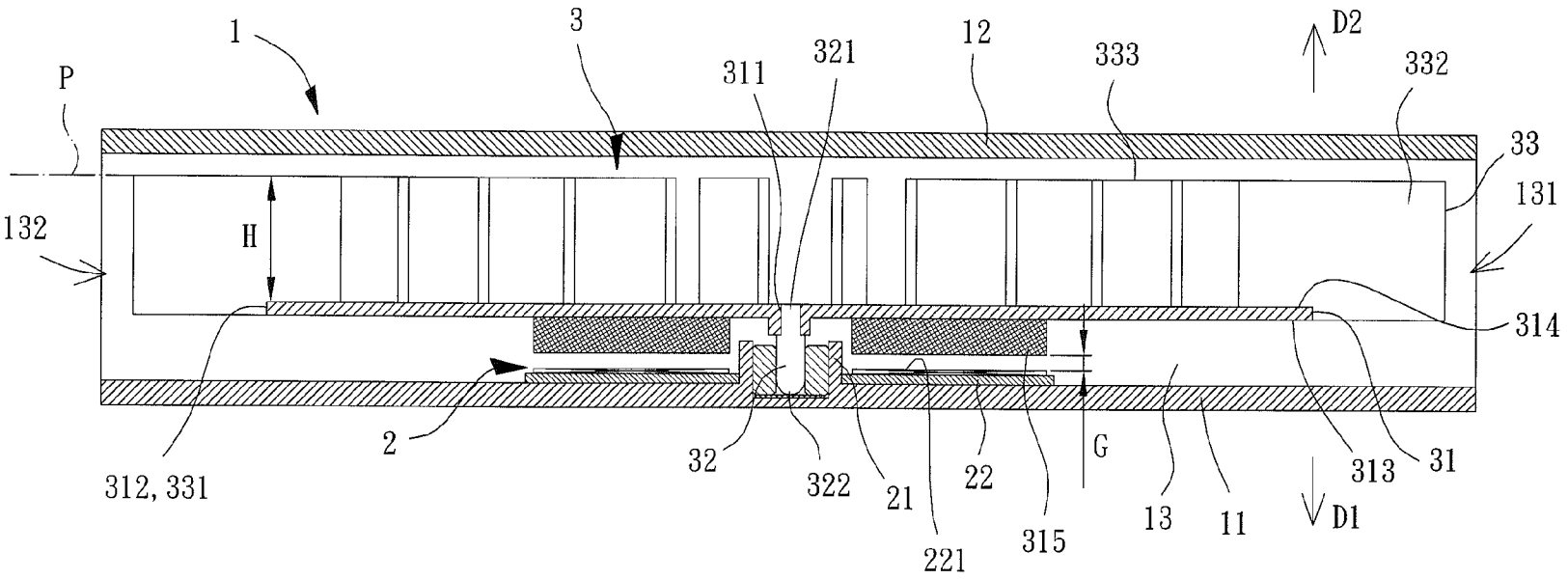
FIG. 4 is a cross-sectional view of the advection-type fan of the first embodiment of the invention.

Referring to FIGS. 3 and 4, an advection-type fan including a fan frame 1, a driving module 2 and an impeller 3 is disclosed according to a first embodiment of the invention. The fan frame 1 is of a form that allows air to flow therethrough in a radial direction. The driving module 2 is disposed in the fan frame 1. The impeller 3 is rotatably coupled with the driving module 2 in order for the driving module 2 to drive the impeller 3 to rotate.

The fan frame 1 is a hollow frame structure that can receive the driving module 2 and the impeller 3. The hollow frame structure may be in various geometric shapes such as a polyhedron, round or oval shape. In this embodiment, the fan frame 1 has a rectangular shape.

Specifically, the fan frame 1 includes a first cover portion 11, a second cover portion 12 spaced from the first cover portion 11 by a distance, and a lateral wall portion 13 arranged between the first and second cover portions 11 and 12 and including an air inlet 131 and an air outlet 132. In such an arrangement, an advection-type fan is formed. The advection-type fan has a closed structure in an axial direction, and the quantity and location of the air inlet 131 and the air outlet 132 may be changed based on different requirements. The first cover portion 11, the second cover portion 12 and the lateral wall portion 13 may be integrally formed. In this embodiment, the first cover portion 11 is integrally formed with the lateral wall portion 13, and the second cover portion 12 is a cover plate that can be assembled to and disassembled from the lateral wall portion 13 to allow disposition of the driving module 2 and the impeller 3 into the fan frame 1. Furthermore, the air inlet 131 faces in a direction A, and the air outlet 132 faces in a direction B perpendicular to the direction A, to provide an angle difference of 90 degrees therebetween (the angle difference between the air inlet 131 and the air outlet 132 can also be smaller than 90 degrees). The opening of the air outlet 132 is smaller than that of the air inlet 131 for increasing air pressure.

The driving module 2 can be of any structure capable of driving the impeller 3 to rotate. The driving module 2 can include basic components such as a coil unit, a circuit board, a plurality of silicon steel plates, a shaft seat, etc. One skilled in the art may readily appreciate that the driving module 2 drives the impeller 3 to rotate under alternating magnetic fields (by cooperating with a permanent magnet of the impeller 3), so it is not described herein again for brevity. In this embodiment, the driving module 2 includes a shaft seat 21 and a base plate 22, with the shaft seat 21 arranged inside the fan frame 1. The shaft seat 21 may be coupled to the fan frame 1 by way of integral formation or assembly. In this embodiment, the shaft seat 21 is coupled with the first cover portion 11 of the fan frame 1. Further, the base plate 22 is fitted around the shaft seat 21 and includes one face having a coil unit 221 formed by layout.

The impeller 3 is rotatably coupled with the driving module 2, with an axial air gap G formed between the impeller 3 and the driving module 2. The advection-type fan of the invention may have a smaller volume and a simplified structure based on the axial gap structure. The impeller 3 includes a metal base plate 31, a shaft 32 coupled to a central portion of the metal base plate 31, and a plurality of plastic blades 33 coupled to an outer periphery of the metal base plate 31.

The metal base plate 31 includes a shaft-coupling portion 311 and a peripheral portion 312 distant from the shaft-coupling portion 311. Arranged between the shaft-coupling portion 311 and the peripheral portion 312 are a first plane 313 and a second plane 314 opposite to the first plane 313. In other words, the portion of the metal base plate 31 between the shaft-coupling portion 311 and the peripheral portion 312 is preferably in the form of a plane (excluding the shaft-coupling portion 311). A direction which the second plane 314 faces the first plane 313 is defined as a first direction D1, and another direction which the first plane 313 faces the second plane 314 is defined as a second direction D2. The first plane 313 is provided with a permanent magnet 315.

The first plane 313 and the second plane 314 of the metal base plate 31 may be uncovered or covered with a plastic or rustproof film. The metal base plate 31 is preferably made of magnetic-conducting material that can provide a shielding function when coupling with the permanent magnet 315. The metal base plate 31 may form the shaft-coupling portion 311 in many ways such as punching or the like. The shaft-coupling portion 311 may be of any structure capable of fixing the shaft 32. In the embodiment, the shaft-coupling portion 311 is a fixing hole formed by a punching process, with the fixing hole having protrusions on a periphery thereof and extending through the first plane 313 and the second plane 314.

The shaft 32 has a fixing end 321 coupled with the shaft-coupling portion 311 of the metal base plate 31. The fixing end 321 of the shaft 32 may be fixed to the shaft-coupling portion 311 by ways of fastening, screwing, welding, close fitting or the like, to prevent solo rotation of the shaft 32 (without driving the metal base plate 31 to rotate at the same time). The top face of the fixing end 321 of the shaft 32 is preferably aligned with or located below the second plane 314 of the metal base plate 31. The shaft 32 also includes a free end 322 distant from the fixing end 321 and extending axially in the first direction D1. After the shaft 32 is assembled to the metal base plate 31, the shaft 32 may be rotatably coupled with the shaft seat 21 of the driving module 2 to form the axial air gap G between the permanent magnet 315 and the coil unit 221 of the driving module 2.

Figure 5:
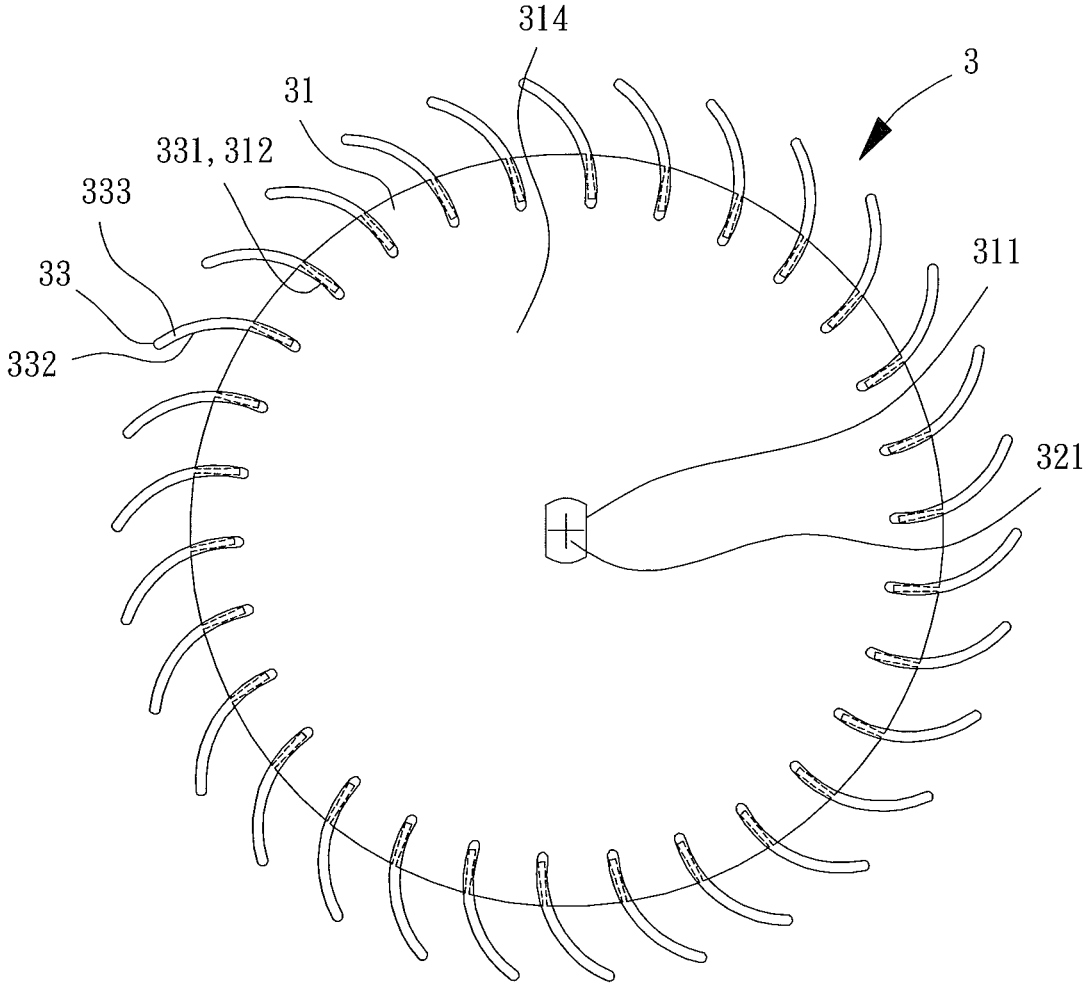
FIG. 5 is a top view of an impeller of the advection-type fan of the first embodiment of the invention.

Each plastic blade 33 has a coupling portion 331 and an air-driving portion 332, with the coupling portion 331 coupled with the peripheral portion 312 of the metal base plate 31. The plastic blades 33 are integrally formed with the peripheral portion 312 of the metal base plate 31 by way of injection molding for convenient manufacturing and assembly. As shown in FIG. 5, the peripheral portion 312 of the metal base plate 31 is preferably in a saw-toothed form or includes a plurality of notches or other similar structures capable of preventing loosening of the plastic blades 33 when the plastic blades 33 are integrally formed with the peripheral portion 312 of the metal base plate 31. The air-driving portion 332 axially extends in the second direction D2, such that the air-driving portions 332 of the plastic blades 33 may be located above the second plane 314 of the metal base plate 31. In such a design, the impeller 3 of the invention is suitable for use in an advection-type fan.

Each plastic blade 33 of the impeller 3 has a top edge 333 facing in the second direction D2 (namely, facing the second cover portion 12). In the embodiment, the top edge 333 of the plastic blade 33 is spaced from the second plane 314 of the metal base plate 31 by an axial height H. Specifically, based on the axial height H, the top edges 333 of the plastic blades 33 may jointly define a horizontal reference plane P, so that a horizontal air-guiding room is constructed between the horizontal reference plane P and the second plane 314 of the metal base plate 31. The horizontal air-guiding room preferably has no hub-like protrusion in order to avoid the airflows from being blocked. The air-driving portions 332 of the plastic blades 33 are annularly arranged to define the horizontal air-guiding room. In such an arrangement, when the impeller 3 drives air in a horizontal direction, the impeller 3 may smoothly guide the air in and out of the advection-type fan through the horizontal air-guiding room. Thus, noises generated by turbulences can be reduced, and the cooling effect may be improved.

When the advection-type fan of the invention is in use, the alternating magnetic fields generated by the driving module 2 may drive the impeller 3 to rotate. Thus, the advection-type fan can be installed in various electronic devices. The plastic blades 33 of the impeller 3 can guide external air into the advection-type fan via the air inlet 131 and expel the air from the advection-type fan via the air outlet 132 to provide a cooling function for a heat source of the electronic device.

The advection-type fan and the impeller thereof are characterized in that the impeller 3 can guide air in and out of the advection-type fan through the air inlet 131 and the air outlet 132 in the horizontal direction. Therefore, the advection-type fan does not necessarily have to be mounted on the top of a heat source, allowing the axial height of the electronic device to be reduced. In addition, the advection-type fan and the impeller thereof can provide a desired auxiliary cooling effect for those heat sources adjacent to the air outlet 132. More importantly, since the second plane 314 does not have any hub-like protrusion and since the air-driving portions 332 of the plastic blades 33 axially extend in the second direction D2, the air guided into the advection-type fan via the air inlet 131 can more smoothly flow over the second plane 314 to the air outlet 132 and then be expelled at the air outlet 132. Thus, the air resistance can be significantly reduced, preventing the occurrence of turbulences and improving the overall cooling effect.

Furthermore, the impeller 3 mainly consists of the metal base plate 31 and the plastic blades 33. The metal base plate 31 may be a thin plate that provides a larger structural strength while reducing the thickness of the impeller 3. In addition, since the air-driving structure of the impeller 3 used to drive the air is made of plastic (plastic blades 33), the manufacturing costs of the impeller 3 are reduced. Thus, the impeller 3 of the invention may have both advantages of small thickness and improved structural strength. More importantly, since the plastic blades 33 of the impeller 3 axially extend in the second direction D2, the air-driving portions 332 of the plastic blades 33 are all located above the second plane 314. This suggests that the plastic blades 33 have sufficient air-driving areas to guide the air in and out of the advection-type fan in the horizontal direction. Therefore, the impeller 3 can well serve as an impeller installed in a thin advection-type fan with improved structural strength.

Figure 6:
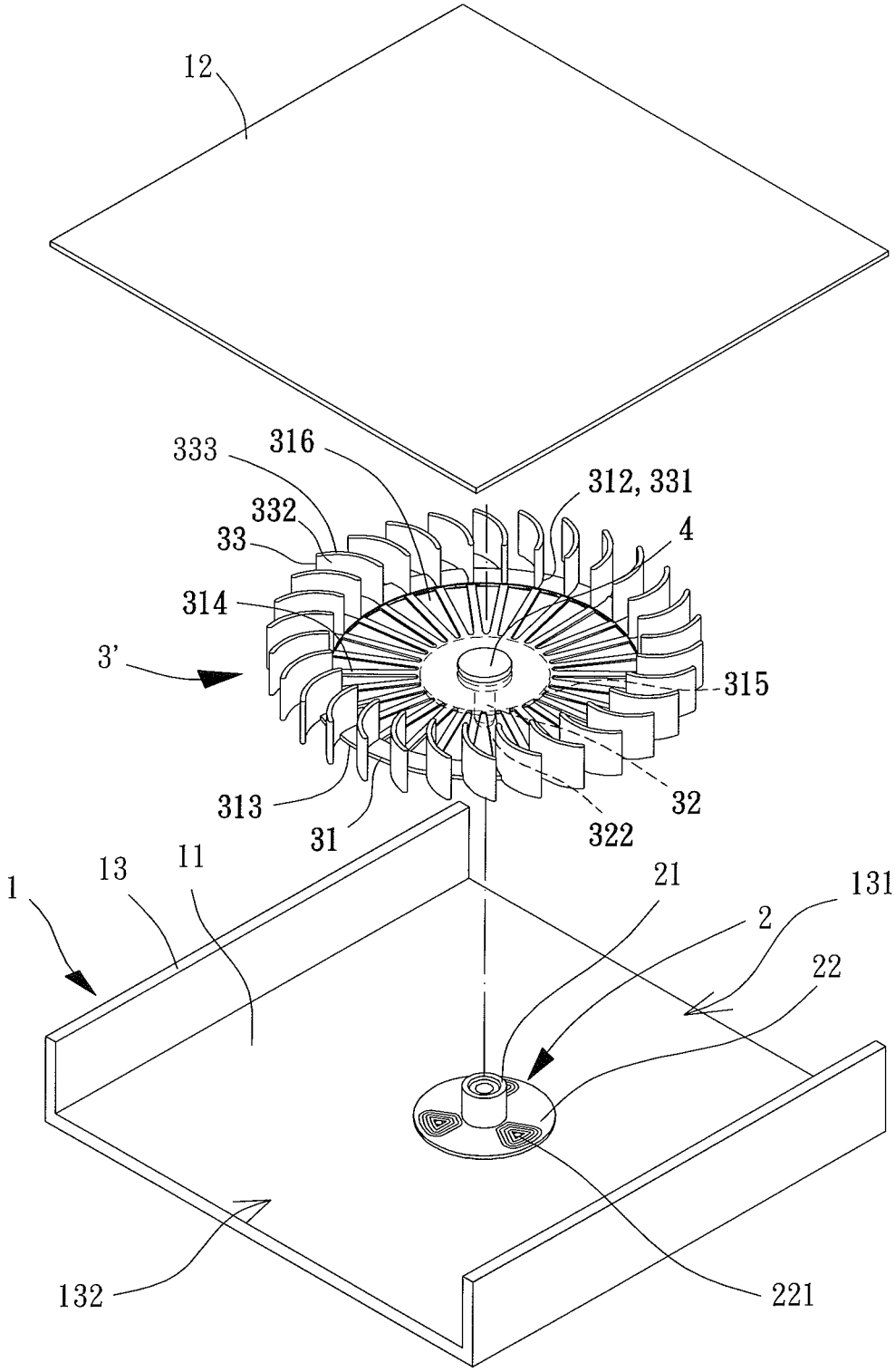
FIG. 6 is an exploded view of an advection-type fan according to a second embodiment of the invention.
Figure 7:
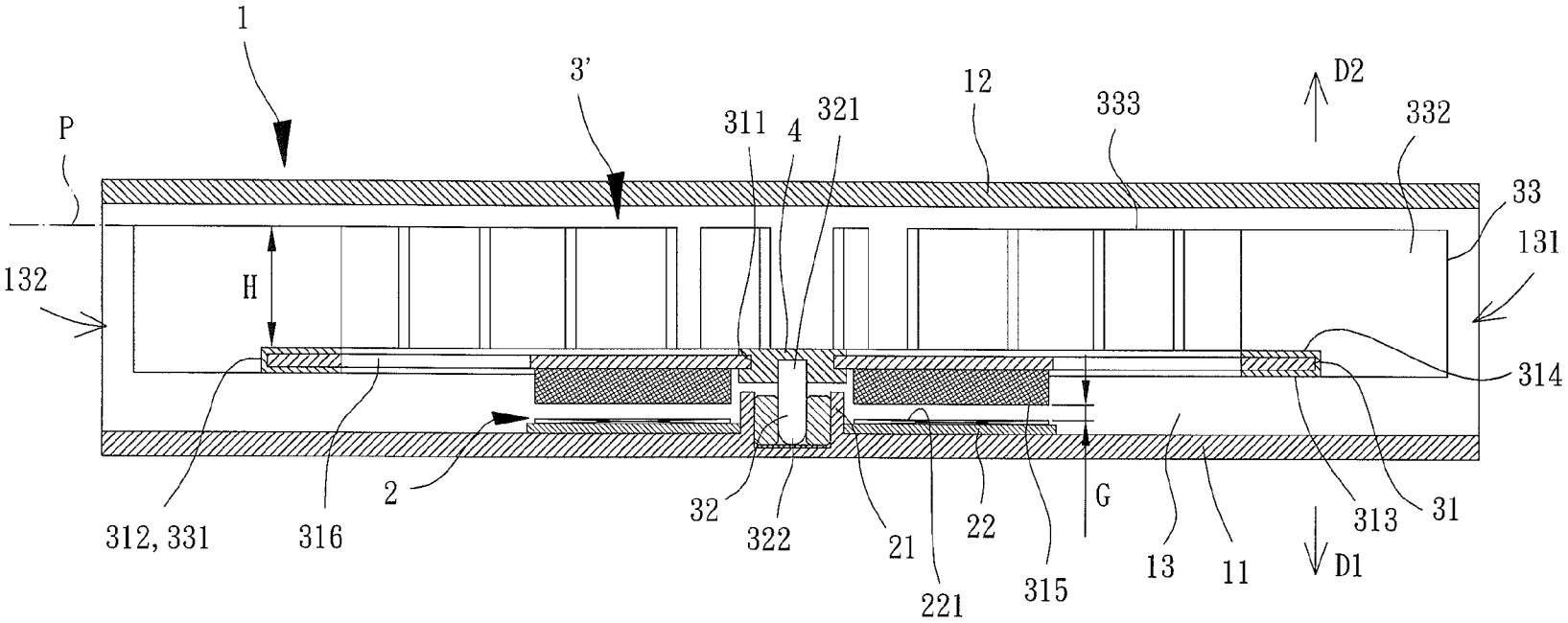
FIG. 7 is a cross-sectional view of the advection-type fan of the second embodiment of the invention.

Referring to FIGS. 6 and 7, an advection-type fan is disclosed according to a second embodiment of the invention. The advection-type fan also includes a fan frame 1, a driving module 2 and an impeller 3'. The fan frame 1 and the driving module 2 in this embodiment have been described in the previous embodiment, so they are not described herein again. In this embodiment, the air inlet 131 and the air outlet 132 are shown to have an angle difference of 180 degrees.

The metal base plate 31 of the impeller 3' further includes a plurality of through-holes 316 extending through the first plane 313 and the second plane 314, with a rib formed between two adjacent through-holes. In such an arrangement, the impeller 3' may retain its predetermined structural strength via the metal base plate 31 having ribs while reducing the amount of metal used. Therefore, the manufacturing costs of the impeller 3' may be efficiently reduced.

Figure 8:
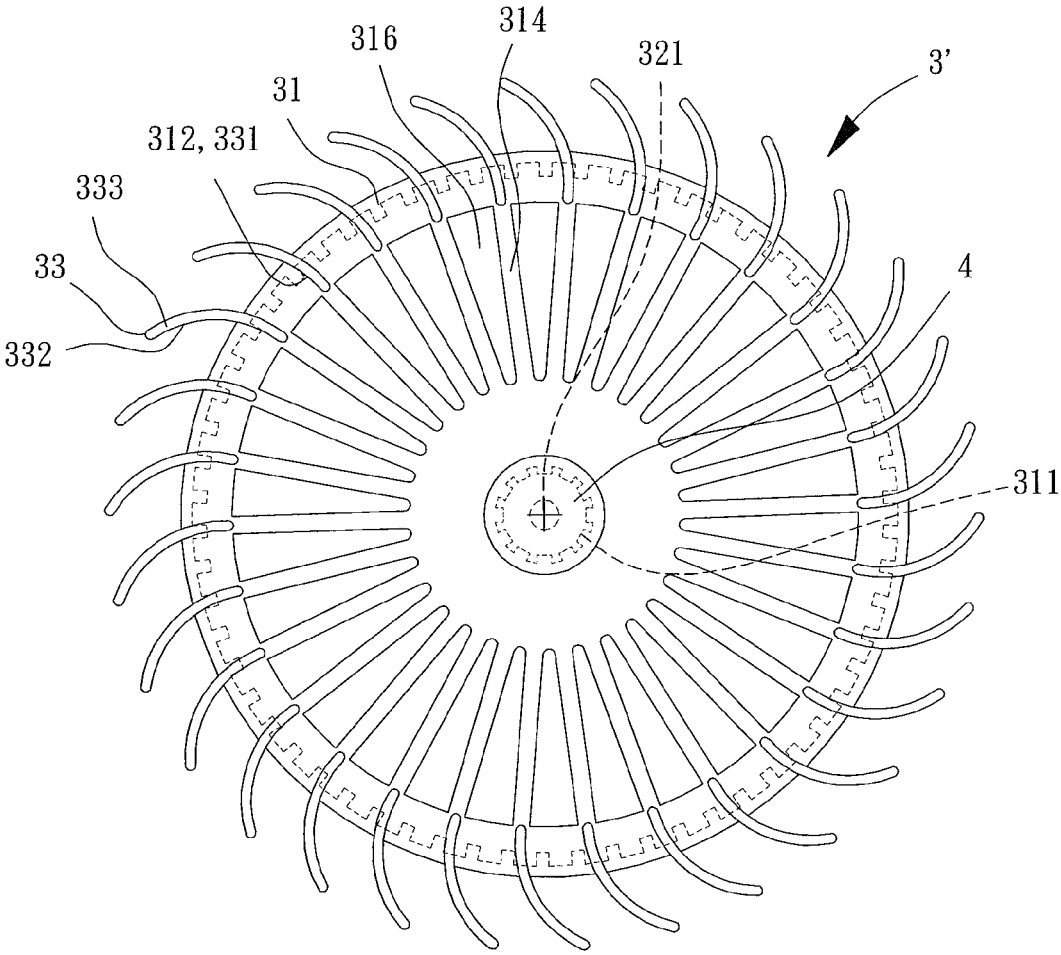
FIG. 8 is a top view of an impeller of the advection-type fan of the second embodiment of the invention.

The shaft 32 of the impeller 3' is preferably coupled with the shaft-coupling portion 311 of the metal base plate 31 via a shaft sleeve 4, to reinforce the coupling between the metal base plate 31 and the shaft 32, as well as provide convenient assembly between the metal base plate 31 and the shaft 32. The shaft sleeve 4 may be a plastic shaft sleeve that integrally couples the shaft 32 with the shaft-coupling portion 311 of the metal base plate 31 by way of injection molding, ensuring securer coupling between the metal base plate 31 and the shaft 32. As shown in FIG. 8, the shaft-coupling portion 311 of the metal base plate 31 preferably forms a plurality of notches or has a saw-toothed inner periphery or a noncircular hole or the like, to efficiently prevent loosening or solo rotation of the shaft sleeve 4 when the shaft sleeve 4 is integrally coupled with the shaft-coupling portion 311 of the metal base plate 31.

Based on the feature that the air-driving portions 332 of the plastic blades 33 of the impeller 3, 3' axially extend in the second direction D2, and since the second plane 314 between the shaft-coupling portion 311 and the peripheral portion 312 does not bend like a hub, air blocking can be avoided when the plastic blades 33 of the impeller 3, 3' guide the air in and out of the advection-type fan in the horizontal direction, attaining the improved cooling efficiency.

Based on the feature that the impeller 3, 3' of the invention may consist of the metal base plate 31 and the plastic blades 33 for reduced thickness and improved structural strength, the air-driving portions 332 of the plastic blades 33 may all be located above the second plane 314 of the metal base plate 31, because the plastic blades 33 of the impeller 3, 3' extend in the second direction D2. As such, the impeller 3, 3' is suitable for use in an advection-type fan.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. An impeller of an advection-type fan comprising:

a metal base plate comprising a shaft-coupling portion and a peripheral portion distant from the shaft-coupling portion, wherein a first plane facing in a first direction and a second plane facing in a second direction opposite to the first direction are arranged between the shaft-coupling portion and the peripheral portion, wherein the metal base plate is in a plane form between the shaft-coupling portion and the peripheral portion, and wherein the first plane is provided with a permanent magnet;

a shaft having a fixing end and a free end distant from the fixing end, wherein the fixing end is coupled with the shaft-coupling portion of the metal base plate, and wherein the free end extends axially in the first direction; and a plurality of plastic blades each having a coupling portion and an air-driving portion, wherein the coupling portion is coupled with the peripheral portion of the metal base plate, wherein the air-driving portion axially extends in the second direction, and wherein the metal base plate further comprises a plurality of through-holes extending through the first and second planes, with a rib formed between two adjacent through-holes.

2. The impeller of an advection-type fan as claimed in claim 1, wherein each plastic blade has a top edge facing in the second direction and spaced from the second plane of the metal base plate by an axial height.

3. The impeller of an advection-type fan as claimed in claim 2, wherein the top edges of the plurality of plastic blades jointly define a horizontal reference plane in which a horizontal air-guiding room is constructed between the horizontal reference plane and the second plane of the metal base plate.

4. The impeller of an advection-type fan as claimed in claim 3, wherein the air-driving portions of the plurality of plastic blades are annularly arranged to define the horizontal air-guiding room.

5. The impeller of an advection-type fan as claimed in claim 1, wherein the air-driving portions of the plurality of plastic blades are located above the second plane of the metal base plate in an axial direction.

6. The impeller of an advection-type fan as claimed in claim MB 1, wherein the fixing end of the shaft is aligned with or located below the second plane of the metal base plate.

7. The impeller of an advection-type fan as claimed in claim 1, wherein the plurality of plastic blades is integrally formed with the peripheral portion of the metal base plate by way of injection molding.

8. The impeller of an advection-type fan as claimed in claim 1, wherein the shaft is coupled with the shaft-coupling portion of the metal base plate via a shaft sleeve.

9. The impeller of an advection-type fan as claimed in claim 8, wherein the shaft sleeve is a plastic shaft sleeve that integrally couples the shaft with the shaft-coupling portion of the metal base plate.

10. The impeller of an advection-type fan as claimed in claim 1, wherein the first and second planes of the metal base plate are uncovered.

11. The impeller of an advection-type fan as claimed in claim 1, wherein the first and second planes of the metal base plate are covered with a plastic or rustproof film.

12. An advection-type fan comprising:

a fan frame comprising a first cover portion and a second cover portion, with a lateral wall portion arranged between the first and second cover portions and comprising an air inlet and an air outlet;

a driving module disposed in the fan frame; and an impeller comprising a metal base plate, a shaft and a plurality of plastic blades, wherein the metal base plate comprises a shaft-coupling portion and a peripheral portion, wherein a first plane facing in a first direction and a second plane facing in a second direction opposite to the first direction are arranged between the shaft-coupling portion and the peripheral portion, wherein the first plane is provided with a permanent magnet, wherein the shaft is coupled with the shaft-coupling portion of the metal base plate and rotatably coupled with the driving module, wherein each plastic blade has a coupling portion and an air-driving portion, wherein the coupling portion is coupled with the peripheral portion of the metal base plate, and wherein the air-driving portion axially extends in the second direction, and wherein the metal base plate further comprises a plurality of through-holes extending through the first and second planes, with a rib formed between two adjacent through-holes.

13. The advection-type fan as claimed in claim 12, wherein the driving module comprises a shaft seat and a base plate, wherein the shaft seat is arranged on the first cover portion of the fan frame, wherein the shaft of the impeller is coupled with the shaft seat of the driving module, wherein the base plate is fitted around the shaft seat and includes one face having a coil unit, and wherein an axial air gap is formed between the permanent magnet of the driving module and the coil unit.

14. The advection-type fan as claimed in claim 12, wherein the metal base plate between the shaft-coupling portion and the peripheral portion is in the form of a plane.

15. The advection-type fan as claimed in claim 12, wherein each plastic blade has a top edge facing in the second direction and spaced from the second plane of the metal base plate by an axial height.

16. The advection-type fan as claimed in claim 15, wherein the top edges of the plurality of plastic blades jointly define a horizontal reference plane in which a horizontal air-guiding room is constructed between the horizontal reference plane and the second plane of the metal base plate.

17. The advection-type fan as claimed in claim 16, wherein the air-driving portions of the plurality of plastic blades are annularly arranged to define the horizontal air-guiding room.

18. The advection-type fan as claimed in claim 12, wherein the air-driving portions of the plurality of plastic blades are located above the second plane of the metal base plate in an axial direction.

19. The advection-type fan as claimed in claim 12, wherein the fixing end of the shaft is aligned with or located below the second plane of the metal base plate.

20. The advection-type fan as claimed in claim 12, wherein the plurality of plastic blades is integrally formed with the peripheral portion of the metal base plate by way of injection molding.

21. The advection-type fan as claimed in claim 12, wherein the shaft is coupled with the shaft-coupling portion of the metal base plate via a shaft sleeve.

22. The advection-type fan as claimed in claim 21, wherein the shaft sleeve is a plastic shaft sleeve that integrally couples the shaft with the shaft-coupling portion of the metal base plate.

23. The advection-type fan as claimed in claim 12, wherein the first and second planes of the metal base plate are uncovered.

24. The advection-type fan as claimed in claim 12, wherein the first and second planes of the metal base plate are covered with a plastic or rustproof film.

25. The advection-type fan as claimed in claim 12, wherein the air outlet has a smaller opening than the air inlet.

* * * * *